US006422209B1

(12) United States Patent
Mattes

(10) Patent No.: US 6,422,209 B1
(45) Date of Patent: Jul. 23, 2002

(54) MAGNET INJECTOR FOR FUEL RESERVOIR INJECTION SYSTEMS

(75) Inventor: Patrick Mattes, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/830,714

(22) PCT Filed: Aug. 17, 2000

(86) PCT No.: PCT/DE00/02783

§ 371 (c)(1),
(2), (4) Date: Aug. 20, 2001

(87) PCT Pub. No.: WO01/16479

PCT Pub. Date: Mar. 8, 2001

(30) Foreign Application Priority Data

Sep. 1, 1999 (DE) ..... 199 41 463

(51) Int. Cl.[7] ..... F02M 37/04
(52) U.S. Cl. ..... 123/467; 123/300
(58) Field of Search ..... 123/467, 446, 123/500, 501, 458, 506, 299, 300

(56) References Cited

U.S. PATENT DOCUMENTS 5,664,545 A * 9/1997 Kato et al. ..... 123/496
5,893,350 A * 4/1999 Timms ..... 123/467
6,085,719 A * 7/2000 Heinz et al. ..... 123/300
6,244,250 B1 * 6/2001 Hlousek ..... 123/467
6,328,017 B1 * 12/2001 Heinz et al. ..... 123/467

FOREIGN PATENT DOCUMENTS

DE 19642001 * 12/1997 ..... 123/467
EP 0331198 * 9/1989 ..... 123/467
EP 0829641 * 3/1998 ..... 123/467

* cited by examiner

*Primary Examiner*—Carl S. Miller
(74) *Attorney, Agent, or Firm*—Ronald E. Greigg

(57) ABSTRACT

The invention relates to a magnet injector for fuel reservoir injection systems, having a fuel inlet and a fuel outlet, a control chamber, which communicates with the inlet, a nozzle which communicates with the inlet and a nozzle needle, which has a tip for closing the nozzle opening and has a shaft end that borders on the control chamber; and a magnet valve which has a first electromagnet, an armature, a valve chamber that communicates with the outlet via a first passage and with the control chamber via a second passage, and a throttle body which is located in the valve chamber and is connected to the armature, wherein the throttle body, in the state of repose of the injector, is kept in a first terminal position, in which it blocks one of the two passages, and is moved toward a second terminal position, in which it opens this passage, by triggering of the first magnet. To make shorter switching times possible, the magnet valve has a second electromagnet, which upon triggering acts on the armature oppositely from the first electromagnet. The throttle body is embodied such that in its second terminal position, it blocks the other of the two passages and along the way between its two terminal positions opens both passages.

16 Claims, 2 Drawing Sheets

MAGNET INJECTOR FOR FUEL RESERVOIR INJECTION SYSTEMS

CROSS-REFERENCE TO RELATED APPLICATIONS

This application is a 35 USC 371 application of PCT/DE 00/02783 filed on Aug. 17, 2000.

BACKGROUND OF THE INVENTION

1. Field of the Invention

The invention relates to a magnet injector for fuel reservoir injection systems, having:

a fuel inlet and a fuel outlet; a control chamber, which communicates with the inlet; a nozzle, which communicates with the inlet; and a nozzle needle, which has a tip for closing the nozzle opening and has a shaft end that borders on the control chamber; and a magnet valve, which has a first electromagnet, an armature, a valve chamber that communicates with the outlet via a first passage and with the control chamber via a second passage, and a throttle body which is located in the valve chamber and is connected to the armature, wherein the throttle body, in the state of repose of the injector, is kept in a first terminal position, in which it blocks one of the two passages, and is moved toward a second terminal position, in which it opens this passage, by triggering of the first magnet. To make shorter switching times possible, the magnet valve has a second electromagnet, which upon triggering acts on the armature oppositely from the first electromagnet.

2. Description of the Prior Art

A magnet injector of this kind is already known from the book entitled "Dieselmotor-Management/Bosch" [Bosch Diesel Engine Management System], pages 274–277 (2nd Edition, 1998, published by Robert Bosch GmbH, ISBN 3-528-03873-X). At present, fuel reservoir injection systems are predominantly used in diesel engines. Along with the injectors for the cylinders, they also have a high-pressure reservoir (common rail) and a high-pressure pump for the fuel. The high-pressure pump compresses the fuel in the reservoir to the so-called system pressure, which at present can be as high as 1350 bar. This reservoir communicates with the fuel inlet of the injector.

In the known magnet injector, the magnet valve has a single electromagnet; the throttle body in its first terminal position blocks the second passage by way of which the valve chamber communicates with the control chamber, and the first passage, by way of which the valve chamber communicates with the outlet, is disposed such that it cannot be blocked by the throttle body. When the magnet is triggered, it attracts the armature, which carries the throttle body along with it until it is in its second terminal position, in which both the second passage to the control chamber and the first passage to the outlet are open.

The mode of operation of the known magnet injector, when the engine is running, can be summarized as follows.

In the state of repose, the injector is closed, and so the fuel cannot pass through the nozzle to reach the combustion chamber of the cylinder. To that end, the electromagnet of the magnet valve is not triggered, and so a valve spring keeps the throttle body in the first terminal position, in which it blocks the second passage to the control chamber. Thus the system pressure applied by the high-pressure reservoir prevails in the control chamber and also prevails in the nozzle.

Since the nozzle needle borders on the control chamber with its shaft end that is opposite its tip, the pressure in the control chamber acts on the shaft end, so that a force in the direction of the tip is exerted on the nozzle needle. A nozzle spring, which serves to prestress the tip into the nozzle opening and thus to close the injector when the engine is not running and high pressure in the high-pressure reservoir is thus absent, likewise exerts a force in the direction of the tip on the nozzle needle. These two closing forces, in the state of repose, exceed the opening force also engaging the nozzle needle; this force originates in the pressure in the nozzle on the tip, which narrows at that point, of the nozzle needle.

At the onset of injection, the injector opens because the magnet valve is triggered. To that end, the so-called attracting current is carried through the electromagnet, which serves to bring about rapid opening of the magnet valve. The magnet valve then exerts a force on the armature, which exceeds the opposite force of the valve spring, so that along its motion toward the electromagnet the armature carries the throttle body along with it and puts it in its second terminal position. As a result, the second passage, by way of which the valve chamber communicates with the control chamber, is opened. Fuel can now flow out of the control chamber through this second passage into the valve chamber and can flow on out through the first passage to the fuel outlet, which communicates with the fuel tank. The pressure in the control chamber consequently drops and is rapidly lower than the pressure in the nozzle, which still is equivalent to the system pressure. Since this reduced pressure in the control chamber is now exerted on the shaft end of the nozzle needle, this closing force on the nozzle needle drops as well, and thus because of the system pressure in the nozzle the opening force predominates, and the nozzle needle is pulled out of the nozzle opening. The fuel at system pressure can now pass through the nozzle opening to emerge from the injector, and the injection begins.

The opening speed of the nozzle needle is determined by the difference between the flow from the fuel inlet into the control chamber and the flow out of the control chamber through the second passage and to the valve chamber. The shaft end of the nozzle needle penetrates into the control chamber far enough that the closing and opening forces on the nozzle needle are equalized, and it then remains in place on a cushion of fuel. This cushion is created by a fuel flow that comes to be established in the control chamber. The nozzle is now fully open, and the fuel is injected into the combustion chamber at a pressure that is approximately equal to the system pressure in the high-pressure reservoir.

At the end of the injection, the magnet valve is no longer triggered, and so the armature is forced away from the electromagnet by the force of the valve spring, and the throttle body again blocks the second passage. Consequently, as a result of the fuel continuing to flow in from the inlet, the system pressure builds up again in the control chamber. This rising pressure causes an increasing force on the nozzle needle. As soon as this closing force from the control chamber and the force of the nozzle spring exceed the opening force from the nozzle, the nozzle needle is moved toward the nozzle opening, until the nozzle opening is again closed by the tip. The closing speed of the nozzle needle is determined by the flow of fuel from the inlet into the control chamber. The injection ends when the nozzle needle reaches its bottom stop and its tip is seated in the nozzle opening. A disadvantage of this known magnet injector, however, is that its switching times are too long to enable a preinjection with replicable, small preinjection quantities of 1 $mm^3$ and less. This is because the magnet valve used allows only a limited armature speed. The speed can be increased by increasing the attracting current, but then armature recoiling occurs to an increasing extent, which causes a ballistic mode of operation with fluctuations in quantity of up to ±50% of the injected quantity. Increased exhaust emissions and fluctuations in constant-velocity operation are the consequence.

SUMMARY OF THE INVENTION

It is therefore the object of the present invention to make a magnet injector of the type defined at the outset available that makes shorter switching times possible, so that even small injection quantities of less than 1 $mm^3$ can be replicably defined.

This object is attained in that:

the magnet valve has a second electromagnet, which upon triggering acts on the armature oppositely from the first electromagnet; and the throttle body is embodied such that in its second terminal position, it blocks the other of the two passages and along the way between its two terminal positions opens both passages.

Consequently, this magnet injector has a magnet valve with two oppositely acting electromagnets and with one common armature. In addition, the throttle body is embodied such that in one of its two terminal positions, it blocks one of the two passages that open into the valve chamber, and opens the other passage, while in its other terminal position, conversely, it opens that passage and blocks the other one.

With this magnet injector, a small injection quantity desired for the preinjection, for instance, is defined simply in that the first electromagnet is triggered with the attracting current, which then attracts the armature.

As a result, the throttle body is moved from its first terminal position to its second terminal position. The time required for this suffices to relieve the control chamber such that a small preinjection is generated. Since in both terminal positions of the throttle body, the fuel flow from the control chamber to the outlet is interrupted, but not along the stroke path of the throttle body, the preinjection is terminated without having to reverse the direction of motion of the throttle body. As a result, in comparison to the known magnet injector with only one electromagnet, the switching time can be reduced markedly.

Furthermore, because of the defined stop of the throttle body at the passage to be blocked, fluctuations in the injection quantity are avoided.

To create the main injection, both electromagnets are triggered, so that the throttle body is moved out of its second terminal position and held in a middle position, in which it opens both passages. In this middle position, the fuel flows constantly out of the control chamber through the second passage into the valve chamber and on through the first passage to the outlet and finally back to the tank. The pressure in the control chamber drops, as in the known magnet injector, so that the shaft end of the nozzle needle is pulled into the control chamber and its tip is pulled out of the nozzle opening. The fuel flowing from the inlet into the control chamber provides for the fuel cushion once the nozzle needle has reached its upper stop.

In the state of repose of the injector, the throttle body can be kept in its first terminal position as a result of the fact that the second electromagnet is triggered. In that case, while the engineering effort and expense are low, nevertheless the requisite current must be furnished by the motor, which with a view to the much longer interval between two injections, compared with the duration of the injection itself, causes a marked drop in efficiency. A valve spring is preferably provided, which prestresses the throttle body into its first terminal position.

It is also preferred that the control chamber communicates with the valve chamber via an outlet throttle and/or with the inlet via an inlet throttle. With the aid of these throttles, the flow from the fuel inlet into the control chamber and the flow out of the control chamber into the valve chamber can be predetermined as desired; these flows for instance determine the opening and closing speed of the nozzle needle or the volume of the fuel cushion in the control chamber when the injector is fully open.

It can advantageously also be provided that a compensation chamber communicates with the inlet, and that the armature is connected to an armature shaft, whose free end face borders on the compensation chamber. This is because as a result, the throttle body is almost completely forcecompensated, so that it can react quickly to the forces exerted by the electromagnet.

BRIEF DESCRIPTION OF THE DRAWINGS

Other features and advantages; of the invention will be apparent from the detailed description contained; below in conjunction with the drawings in which.

DESCRIPTION OF PREFERRED EMBODIMENTS

Figure 1:
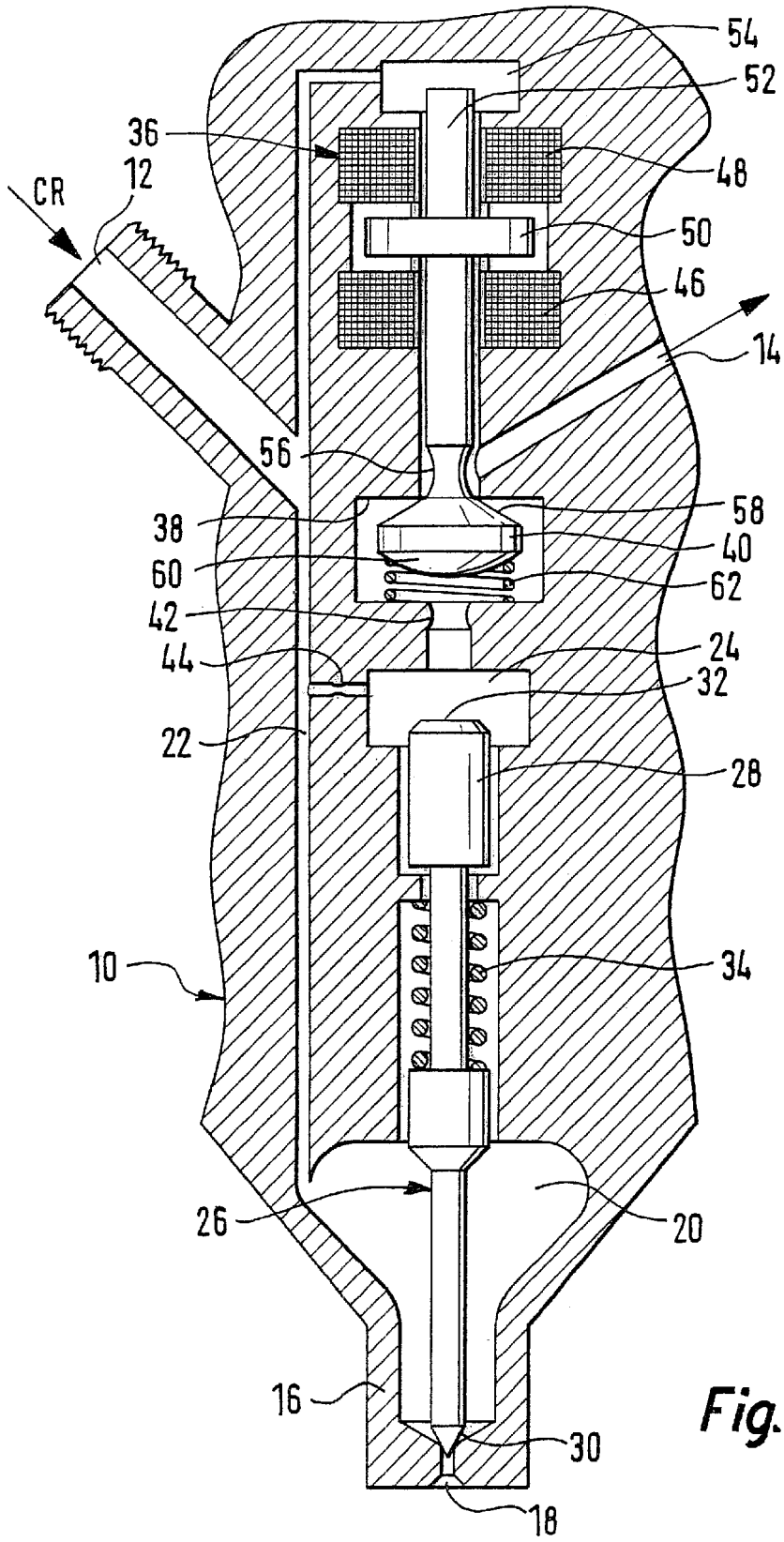
FIG. 1 is a schematic cross section through a magnet injector according to the invention.

In FIG. 1, a magnet injector for the fuel reservoir injection system of a diesel engine is shown schematically in cross section. The injector has a housing 10, which communicates with the high-pressure reservoir (or common rail, not shown) of the reservoir injection system via a fuel inlet 12 and with the fuel tank (not shown) via a fuel outlet 14. The high-pressure reservoir communicates in turn via a high-pressure pump (not shown) with the fuel tank, which compresses the fuel in the reservoir to the system pressure, at which the injection is to take place.

On the lower end, the housing 10 has a nozzle 16 with a nozzle opening 18 and with a nozzle chamber 20 located above the nozzle opening. The nozzle chamber 20 communicates with the inlet 12 via a nozzle conduit 22 in the housing 10. The housing 10 furthermore has a longitudinal bore, which discharges at its lower end into the nozzle chamber 20 and at its upper end into a control chamber 24.

The injector furthermore has a nozzle needle 26, which includes a shaft 28 and, on its lower end, a tip 30 for closing the nozzle opening 18. The shaft 28 is guided displaceably in the longitudinal bore of the housing 10, so that its free, upper end face, which will also be called the shaft end 32 of the needle 26 here, defines the control chamber 24 at the bottom.

In a middle portion, the shaft 28 is stepped back to a reduced diameter, so that it can receive a nozzle spring 34, which is braced by its lower end on the shoulder at the lower end of this portion and by its upper end on a further shoulder, which is formed by a protrusion of the longitudinal bore. Thus the nozzle spring 34 exerts a downward-oriented prestressing force, that is, a prestressing force toward the nozzle opening 18, on the needle 26.

In its housing 10 the injector also has a magnet valve 36, which in the embodiment shown in FIG. 1 is disposed above the control chamber 24. This valve includes a valve chamber 38 and a throttle body 40 received in the valve chamber. The valve chamber 38 communicates with the control chamber 24 via an outlet throttle 42, which in turn communicates with the inlet 12 via an inlet throttle 44. The valve 36 furthermore has a first electromagnet 46 and a second electromagnet 48, as well as a common armature 50 located between the electromagnets.

The two electromagnets 46, 48 are disposed coaxially around a further bore (hereinafter called the armature bore) in the housing 10; on its lower end, this bore discharges into the valve chamber 20, and on its upper end, it discharges into a compensation chamber 54 that communicates with the inlet 12.

The armature 50 is secured on an armature shaft 52, which is guided displaceably in the armature bore and whose free upper end face defines the compensation chamber 54 at the bottom. The armature shaft 52 extends downward as far as the lower end of the armature bore, from which the outlet 14 branches off. Its lower end is embodied as a waist 56 and is secured to the throttle body 40.

Thus via a first passage, which is defined by the lower end of the armature bore and by the waist 56, the valve chamber 38 communicates with the outlet 14, and via a second passage, which is formed by the outlet throttle 42, it communicates with the control chamber 24.

Adjacent to the lower end of the armature shaft 52, the throttle body 40 has a first sealing face 58, and on its lower, free end face it has a second sealing face 60. Both the edge of the orifice of the armature bore into the valve chamber 38 and the edge of the orifice of the outlet throttle 42 into the valve chamber 38 are embodied as first and second sealing seats, respectively, that fit the sealing faces. A valve spring 62 is braced on the lower, free end face of the throttle body 40 and on the lower wall of the valve chamber 38 and thus exerts an upward-oriented prestressing force, that is, a force oriented toward the first sealing seat, on the throttle body 40.

The mode of operation of this injector will now be described for an injection event with a preinjection and main injection, referring further to FIGS. 2*a* and 2*b*.

When the high-pressure pump of the reservoir injection system is not running, for instance because it is defective or because the engine is off, then the system pressure in the high-pressure reservoir cannot be maintained, and the injector should remain closed so that fuel cannot flow uncontrolled out into the combustion chamber. Since in this case the two opposed hydraulic forces acting on the nozzle needle 26, which originate in the pressures in the control chamber 24 and the nozzle chamber 20, are approximately of equal magnitude, the nozzle spring 34 assures that the tip 30 of the nozzle needle 26 will be pressed into the nozzle opening 18. The injector is accordingly closed.

When the high-pressure pump is running, the system pressure is built up in the reservoir and maintained, so that fuel can be injected as desired into the combustion chamber via the injector.

In the state of repose, that is, between two injection events, the injector should be closed, so that no fuel can reach the combustion chamber. To that end, the two electromagnets 46, 48 are not triggered, so that they cannot exert any control forces on the armature 50 and on the throttle body 40 connected to it. In that case, the two pressures in the valve chamber 38 and the compensation chamber 54 are equal to the system pressure supplied from the high-pressure reservoir via the fuel inlet 12. Since furthermore the orifices of the valve bore into the valve chamber 38 and into the compensation chamber 54 have the same diameter, the throttle body 40 is balanced with regard to the hydraulic forces. In other words, the valve spring 62 assures that the throttle body 40 is pressed by its first, upper sealing face 58 against the first sealing seat and is kept in this position, hereinafter also called the first terminal position.

Figure 2A:
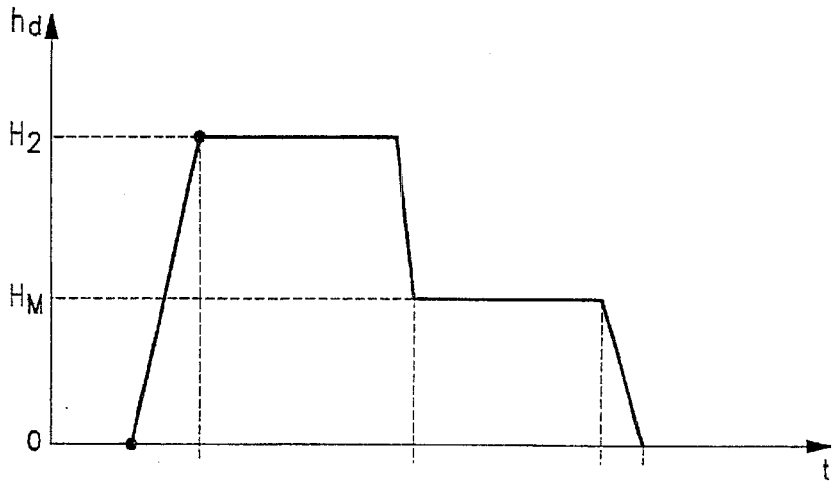
FIGS. 2*a* and 2*b* are timing diagrams, which show the stroke of the throttle body and the resultant stroke of the nozzle needle during the injection event.

In FIG. 2*a*, the stroke $h_d$ of the throttle body 40 is plotted over time t. In the state of repose of the injector, the first terminal position is accordingly equivalent to the stroke $h_d=0$.

In this first terminal position, the throttle body 40 accordingly blocks the first passage, so that no fuel can flow out of the injector via the outlet 14. Thus both in the control chamber 24 and in the valve chamber 38, the system pressure applied by the high-pressure reservoir via the inlet 12 and the inlet throttle 44 prevails. Via the inlet 12 and the nozzle conduit 22, this system pressure also prevails in the nozzle chamber 20.

Since the nozzle needle 26 with its shaft end 32 borders on the control chamber 24, the system pressure in the control chamber 24 acts on the shaft end 32, so that from there a hydraulic force in the direction of the tip 30 is exerted on the nozzle needle 26. The nozzle spring 34 likewise exerts a force in the direction of the tip 30 on the nozzle needle 26. These two closing forces, in the state of repose, exceed the hydraulic opening force also engaging the nozzle needle 26, which opening force originates in the system pressure in the nozzle chamber 20 exerted on the lower end of the nozzle needle 26, that is, the end that tapers there to form the tip 30.

The injector is accordingly closed.

Figure 2B:
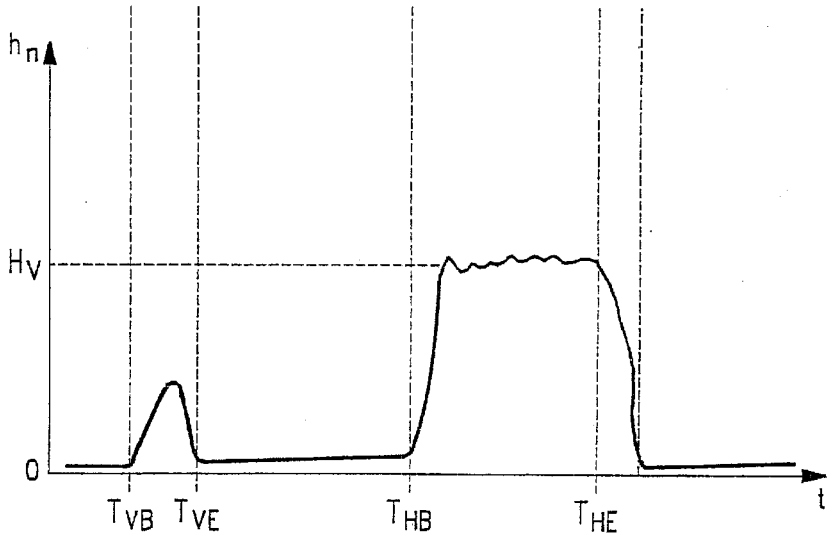

In FIG. 2*b*, the stroke $h_n$, of the nozzle needle 26 is plotted over time t, analogously to FIG. 2*a*. In the state of repose of the injector, the needle tip 30 seated in the nozzle opening 18 is accordingly equivalent to the stroke $h_n=0$.

The preinjection begins at time $t=T_{VB}$ in FIGS. 2*a* and 2*b*, as a result of the triggering of the first electromagnet 46. The triggering current is dimensioned such that the magnetic force exerted by the first electromagnet 46 on the armature 50 exceeds the opposed force of the valve spring 62, so that the armature 50 moves the throttle body 40 out of the first terminal position and in the direction of the second terminal position.

In FIG. 2*a*, this course of the throttle body 40 is represented by the line that, beginning at time $t=T_{VB}$, rises from $h_d=0$.

As soon as the first sealing face 58 is no longer resting on the first sealing seat, the first passage is opened. Fuel can now flow out of the valve chamber 38 through the first passage to the outlet 14. Since furthermore along the course of the throttle body 40 between its two terminal positions the second sealing face 60 is likewise not (yet) resting on the second sealing seat, fuel can also flow out of the control chamber 24 into the valve chamber 38 through the second passage, that is, the outlet throttle 42. Consequently, the pressure in the control chamber 24 drops and is rapidly lower than the pressure in the nozzle chamber 20, which still corresponds to the system pressure, since the inlet throttle 44 and the long nozzle conduit 22 prevent an overly rapid relief of pressure.

Because of the dropping pressure in the control chamber 24, the triggering current of the first electromagnet 46 can be reduced, since on the one hand the distance from the armature 50 decreases, and on the other the hydraulic force of the compensation chamber 54, in which the system pressure still prevails as before, is above that in the control chamber 24.

Since this reduced pressure in the control chamber 24 is now exerted on the shaft end 32, the hydraulic closing force on the nozzle needle 26 drops as well, so that the opening force predominates because of the system pressure in the nozzle chamber 20, and the needle tip 30 is pulled out of the nozzle opening 18. The fuel which is under system pressure can now emerge from the injector through the nozzle opening 18; the preinjection begins.

In FIG. 2*b*, this motion of the nozzle needle 26 is represented by the line that at first, beginning at time $t=T_{VB}$, rises from $h_d=0$.

The preinjection is ended as soon as the throttle body has reached the second terminal position, which in FIG. 2*a* happens at time $t=T_{VE}$. The second sealing face 60 now rests on the second sealing seat and is pressed against it, since the first electromagnet 46 is still triggered. In this second terminal position of the throttle body 40, the second passage of the valve chamber 38 is blocked. The fuel flow out of the control chamber 24 through the valve chamber 38 to the outlet 14 is consequently interrupted, and thus the pressure in the control chamber 24 cannot drop any further, and instead, the system pressure builds up there again. This is brought about by fuel that continues to flow out of the high-pressure reservoir through the inlet 12 and the inlet throttle 44 into the control chamber 24, but can no longer escape through the second passage into the valve chamber 38 and onward to the outlet 14 as was previously possible during the motion of the throttle body 40.

The hydraulic closing force on the nozzle needle 26 consequently increases, until together with the closing force of the nozzle spring 34, it becomes greater than the hydraulic opening force from the nozzle chamber 20. As a result, the motion of the nozzle needle 26 is reversed, and the needle tip 30 is pressed back into the nozzle opening 18.

Thus, as shown in FIG. 2*a*, although the stroke of the throttle body 40 during the preinjection increases steadily up to the maximum $h_d=h_2$ (corresponding to the second terminal position) at time $t=T_{VE}$, nevertheless, as shown in FIG. 2*b*, the stroke of the nozzle needle 26 after reaching its maximum drops back again to $h_n=0$.

The injector is then closed again, and the preinjection is ended.

In the interval between the preinjection and the main injection, the throttle body 40 is kept in the second terminal position, and the injector is thus kept closed, because the first electromagnet 46 continues to be triggered. The requisite triggering current of the first electromagnet 46 for this purpose is markedly less than at the beginning of the preinjection, since the armature 50 is located much closer to this electromagnet.

In FIGS. 2*a* and 2*b*, for the period of time $T_{VE}<t<T_{HB}$ ($T_{HB}$ stands for the onset of the main injection), the stroke of the throttle body is shown as constant at $h_d=h_2$ and the stroke of the nozzle needle is shown as constant at $h_n=0$.

The main injection is initiated at time $t=T_{HB}$, in that both electromagnets 46, 48 are triggered. First, the current 20 through the first electromagnet 46 is reduced enough that its magnetic force, exerted on the armature 50, is less than the prestressing force of the valve spring 62 acting on the throttle body 40; the hydraulic force of the control chamber 24 is of no significance in this respect, since as before, it is compensated for by the hydraulic force of the compensation chamber 54. The throttle body 40 is consequently displaced out of the second terminal position and in the direction of the first terminal position.

Unlike the preinjection, however, the throttle body 40 will not reach the first terminal position but will instead be kept in a middle position, as a result of the triggering of the second electromagnet 48 as well.

In FIG. 2*a*, this course of the throttle body 40 is represented by the line that at first, beginning at time $t=T_{HB}$, drops from steeply from $h_d=h_2$ to $h_d=H_M$ (corresponding to the middle position), and then remains constant.

Since in the middle position both passages are open, as before in the preinjection fuel can flow out of the control chamber 24 to the outlet 14 via the valve chamber 38. The pressure in the control chamber 24 consequently drops, so that once again the hydraulic opening force of the nozzle chamber 20 on the nozzle needle 26 predominates, and the needle tip 30 is pulled out of the nozzle opening 18. The main injection begins.

In FIG. 2*b*, this motion of the nozzle needle 26 is represented by the line that, beginning at time $t=T_{HB}$, rises more and more steeply from $h_n=0$.

The opening speed of the nozzle needle 26 is determined by the difference between the flow out of the inlet 12 through the inlet throttle 44 into the control chamber 24 and the flow out of the control chamber 24 through the outlet throttle 42 into the valve chamber 38.

The shaft end 32 penetrates so far into the control chamber 24 that the closing and opening forces on the nozzle needle 26 are balanced, and then it remains on a fuel cushion. This cushion is created by the fuel flow that is established in the control chamber 24. The nozzle 16 is now fully opened, and the fuel is injected into the combustion chamber at a pressure that is approximately equivalent to the system pressure in the high-pressure reservoir.

As long as the throttle body 40 is kept in the middle position at $h_d=H_M$ by the magnetic control forces of the two electromagnets 46, 48, the nozzle 16 also remains fully opened.

In FIG. 2*b*, this is represented by the line that remains at the maximum $h_n=H_V$ (corresponding to the fully opened nozzle).

At the end of the main injection, the two electromagnets 46, 48 are no longer triggered, so that the armature 50 is pressed by the prestressing force of the valve spring 62 in the direction of the second electromagnet 48, until the throttle body 40 reaches the first terminal position again and blocks the first passage. This motion can be reinforced by switching off the first electromagnet 46 before the second electromagnet 48. The throttle body 40 is kept in the first terminal position by the valve spring 62.

In FIG. 2*a*, this course of the throttle body 40 is represented by the line that, beginning at time $t=T_{HE}$ ($T_{HE}$ stands for the end of the main injection), drops from $h_d=H_M$ to $h_d=0$.

Since now the first sealing face 58 rests on the first sealing seat, in the control chamber 24, because of the fuel continuing to flow in from the inlet 12, the system pressure builds up again. As soon as the increasing hydraulic closing force of the control chamber 24 and the prestressing force of the nozzle spring 34 together exceed the hydraulic opening force of the nozzle chamber 20, the nozzle needle 26 is moved in the direction of the nozzle opening 18, until this nozzle opening is closed by the needle tip 30.

In FIG. 2*b*, this motion of the nozzle needle 26 is represented by the line that, beginning at time $t=T_{HE}$m drops from $h_n=H_v$ to $h_n=0$.

The closing speed of the nozzle needle is determined by the flow of fuel out of the inlet 12 through the inlet throttle 44 into the control chamber 24.

The main injection is terminated when the nozzle needle reaches its bottom stop and its tip 30 is seated in the nozzle opening 18.

The injector is now once again in its state of repose.

The foregoing relates to preferred exemplary embodiments of the invention, it being understood that other variants and embodiments thereof are possible within the spirit and scope of the invention, the latter being defined by the appended claims.

I claim:

1. In a magnet injector for fuel reservoir injection systems, having:

a fuel inlet (12) and a fuel outlet (14);

a control chamber (24), which communicates with the inlet (12);

a nozzle (16), which communicates with the inlet (12); and a nozzle needle (26), which has a tip (30) for closing the nozzle opening (18) and has a shaft end (32) that borders on the control chamber (24); and a magnet valve (36), which has a first electromagnet (46), an armature (50), a valve chamber (38) that communicates with the outlet (14) via a first passage and with the control chamber (24) via a second passage (42), and a throttle body (40) which is located in the valve chamber (38) and is connected to the armature (50), wherein the throttle body (40), in the state of repose of the injector, is kept in a first terminal position, in which it blocks one of the two passages, and is moved toward a second terminal position, in which it opens this passage, by triggering of the first magnet (46), the improvement wherein the magnet valve (36) has a second electromagnet (48), which upon triggering acts on the armature (50) oppositely from the first electromagnet (46); and the throttle body (40) is embodied such that in its second terminal position, it blocks the other (42) of the two passages and along the way between its two terminal positions opens both passages.

2. The injector of claim 1, wherein a valve spring (62) is provided, which prestresses the throttle body (40) into its first terminal position.

3. The injector of claim 1, wherein the control chamber (24) communicates with the valve chamber (38) via an outlet throttle (42) and/or with the inlet (12) via an inlet throttle (44).

4. The injector of claim 1, wherein a compensation chamber (54) communicates with the inlet (12), and that the armature (50) is connected to an armature shaft (52), whose free end face borders on the compensation chamber (54).

5. The injector of claim 1, wherein the orifice of the first passage into the valve chamber (38) and/or the orifice of the second passage (42) into the valve chamber (38) has a sealing seat that fits the throttle body (40).

6. The injector of claim 2, wherein the control chamber (24) communicates with the valve chamber (38) via an outlet throttle (42) and/or with the inlet (12) via an inlet throttle (44).

7. The injector of claim 2, wherein a compensation chamber (54) communicates with the inlet (12), and that the armature (50) is connected to an armature shaft (52), whose free end face borders on the compensation chamber (54).

8. The injector of claim 3, wherein a compensation chamber (54) communicates with the inlet (12), and that the armature (50) is connected to an armature shaft (52), whose free end face borders on the compensation chamber (54).

9. The injector of claim 6, wherein a compensation chamber (54) communicates with the inlet (12), and that the armature (50) is connected to an armature shaft (52), whose free end face borders on the compensation chamber (54).

10. The injector of claim 2, wherein the orifice of the first passage into the valve chamber (38) and/or the orifice of the second passage (42) into the valve chamber (38) has a sealing seat that fits the throttle body (40).

11. The injector of claim 3, wherein the orifice of the first passage into the valve chamber (38) and/or the orifice of the second passage (42) into the valve chamber (38) has a sealing seat that fits the throttle body (40).

12. The injector of claim 6, wherein the orifice of the first passage into the valve chamber (38) and/or the orifice of the second passage (42) into the valve chamber (38) has a sealing seat that fits the throttle body (40).

13. The injector of claim 4, wherein the orifice of the first passage into the valve chamber (38) and/or the orifice of the second passage (42) into the valve chamber (38) has a sealing seat that fits the throttle body (40).

14. The injector of claim 7, wherein the orifice of the first passage into the valve chamber (38) and/or the orifice of the second passage (42) into the valve chamber (38) has a sealing seat that fits the throttle body (40).

15. The injector of claim 8, wherein the orifice of the first passage into the valve chamber (38) and/or the orifice of the second passage (42) into the valve chamber (38) has a sealing seat that fits the throttle body (40).

16. The injector of claim 9, wherein the orifice of the first passage into the valve chamber (38) and/or the orifice of the second passage (42) into the valve chamber (38) has a sealing seat that fits the throttle body (40).

* * * * *